US007435305B2

(12) United States Patent
Shoji et al.

(10) Patent No.: US 7,435,305 B2
(45) Date of Patent: Oct. 14, 2008

(54) CAST ALUMINUM ALLOY COMPRESSOR WHEEL FOR A TURBOCHARGER

(75) Inventors: Ryo Shoji, Tokyo (JP); Takayuki Sotome, Tokyo (JP); Toshiya Okada, Tokyo (JP); Yoki Hirano, Tokyo (JP)

(73) Assignee: Furukawa-Sky Aluminum Corp., Tokyo (JP)

( * ) Notice: Subject to any disclaimer, the term of this patent is extended or adjusted under 35 U.S.C. 154(b) by 119 days.

(21) Appl. No.: 11/038,768

(22) Filed: Jan. 21, 2005

(65) Prior Publication Data

US 2005/0167009 A1 Aug. 4, 2005

(30) Foreign Application Priority Data

Jan. 26, 2004 (JP) ..... 2004-017590

(51) Int. Cl.
*C22C 21/12* (2006.01)

(52) U.S. Cl. ..... 148/417; 420/533; 420/538

(58) Field of Classification Search ..... 148/416–418; 420/533, 538

See application file for complete search history.

(56) References Cited

U.S. PATENT DOCUMENTS 4,062,704 A * 12/1977 Sperry et al. ..... 420/533
4,556,528 A 12/1985 Gersch et al.
5,338,510 A * 8/1994 Zuech ..... 420/532

FOREIGN PATENT DOCUMENTS

| | | |
|---|---|---|
| JP | 10-58119 | 3/1998 |
| JP | 10-212967 | 8/1998 |
| JP | 11-343858 | 12/1999 |

OTHER PUBLICATIONS

'ASM Handbook: vol. 15 Casting', ASM International, 'http://products.asminternational.org/hbk/index.jsp', 2002, p. 1-6.*

* cited by examiner

*Primary Examiner*—Roy King
*Assistant Examiner*—Janelle Morillo
(74) *Attorney, Agent, or Firm*—Westerman, Hattori, Daniels & Adrian, LLP.

(57) ABSTRACT

A compressor wheel made of a cast aluminum alloy, wherein the cast aluminum alloy contains Cu 1.4 to 3.2 mass %, Mg 1.0 to 2.0 mass %, Ni 0.5 to 2.0 mass %, Fe 0.5 to 2.0 mass %, and at least one selected from the group consisting of Ti 0.01 to 0.35 mass %, Zr 0.01 to 0.30 mass %, Sc 0.01 to 0.8 mass %, and V 0.01 to 0.5 mass %, with the balance being aluminum and inevitable impurities, with the [(Cu content)+ 0.5×(Mg content)] being 3.8 mass % or less, and with a secondary dendrite arm spacing being 50 μm or less, wherein the cast aluminum alloy is being reinforced by a solution treatment and an aging treatment, and wherein the compressor wheel shows good heat resistant strength, and is for use in a turbocharger.

9 Claims, 1 Drawing Sheet

CAST ALUMINUM ALLOY COMPRESSOR WHEEL FOR A TURBOCHARGER

FIELD OF THE INVENTION

The present invention relates to a compressor wheel made of a cast aluminum alloy capable of use for a turbocharger for an internal combustion engine for use, for example, in automobiles and ships.

BACKGROUND OF THE INVENTION

The turbocharger for an internal combustion engine for use, for example, in automobiles and ships, is constructed by providing a compressor wheel (compressor impeller) 2 whose rotating axis is identical with that of a turbine wheel (turbine impeller) 1 rotated by exhaust energy, as illustrated in FIG. 1. The compressor wheel 2 is provided for feeding air compressed by high-speed rotation to an internal combustion engine 3. In FIG. 1, reference numeral 4 denotes air, reference numeral 5 denotes compressed air, and reference numerals 6 and 7 denote flow of an exhaust gas at respective sites. Reference numeral 8 denotes a shaft connecting the turbine wheel 1 to the compressor wheel 2. FIG. 2 shows an example of the shape of the compressor wheel. The compressor wheel is configured so that a plurality of thin blades 11 protrude out from a disk 10 integrated with a rotation center shaft (boss) 9. The compressor wheel is heated at a temperature as high as about 150° C. during high-speed rotation, while the vicinity of the center of rotation, particularly the disk, suffers high stress caused by torsional stress and centrifugal force from the rotation shaft.

The compressor wheel is constructed with various materials depending on the demand for performance of the turbocharger. The wheel is generally shaped by cutting an aluminum alloy hot-forged material, for use in larger-size engines, such as for ships. However, for relatively smaller wheels for automobiles engines, such as for passenger cars and trucks, or small-size ships engines, easily-castable aluminum alloys containing Si as a major additive element, for example, those good in castability as defined in JIS-AC4CH (an alloy of Al-7% Si-0.3% Mg), ASTM-354.0 (an alloy of Al-9% Si-1.8% Cu-0.5% Mg) and ASTM-C355.0 (an alloy of Al-5% Si-1.3% Cu-0.5% Mg), are cast in a plaster mold, by a low-pressure or reduced-pressure casting method or a gravity casting method, and the cast alloy is subjected to a solution treatment and/or an aging treatment, to strengthen to be widely used, since mass productivity and production cost are emphasized. The basic production methods thereof are disclosed in detail in U.S. Pat. No. 4,556,528.

Meanwhile, a high compression ratio of air has been required in the turbocharger in recent years, to improve output power of the internal combustion engine, and high-speed rotation is naturally required for this purpose. However, heat values generated by air compression by increasing the rotation speed are increased, and the turbine wheel at the exhaust side is heated at a high temperature. Consequently, the compressor wheel is also heated at a high temperature, due to heat conduction from the turbine wheel. It has been revealed that continuous normal rotation is impossible in a compressor wheel made of the above conventional easily-castable aluminum alloy containing Si as a principal additive element, since it is apt to cause such trouble as deformation during operation and further breakage by fatigue. In particular, while the upper limit available for use in the existing conventional compressor wheel is about 150° C., development of a compressor wheel capable of use at a temperature of about 180° C. has been strongly required to attain the objects described above.

Accordingly, it may be conceived to change the composition of the aluminum alloy to another composition excellent in high-temperature mechanical strength, for example, an alloy defined in JIS-AC1B (an alloy of Al-5% Cu-0.3% Mg). However, since the compressor wheel has a complex shape with thin blade portions thereon, fluidity of a molten alloy of this alloy is so poor that the molten alloy tends to cause miss run in the thin portions (poor filling), as described in paragraph [0011], page 2, in the specification of JP-A-10-58119 ("JP-A" means unexamined published Japanese patent application). Accordingly, JP-A-10-58119 proposes a method in which an easily-castable alloy, such as an Al—Si-series alloy, for example, AC4HC, is used for the blade portion that emphasizes run of the molten alloy, while a high-strength alloy, such as Al—Cu-series alloy, for example, AC1B, is used from the boss portion to the disk portion, where sufficient strength is required to join the rotation shaft; and, the molten alloys of these alloys are independently poured into the mold in two steps, followed by combining the two portions, to form the compressor wheel. JP-A-10-212967 proposes a method for forming the compressor wheel in which an alloy good in castability is used for the blade portion, while a composite reinforced material, prepared by strengthening a reinforce material, such as 25% B-aluminum whiskers, which is impregnated with aluminum, is used at the portion from the boss portion through the central portion of the disk that suffers from stress; and these portions are separately produced, and are joined thereafter to form the compressor wheel. JP-A-11-343858 proposes to join these portions by friction welding.

As described above, no compressor wheels made of cast aluminum alloys that are durable to an increased temperature caused by an increase of the rotation speed have been industrially manufactured using a single alloy. Further, the methods described above, in which different materials are independently used for the blade portion and boss portion, respectively, have not been industrially applied yet, since these methods are poor in productivity to result in increase of the production cost.

SUMMARY OF THE INVENTION

The present invention resides in a compressor wheel made of a cast aluminum alloy, wherein the cast aluminum alloy comprises Cu 1.4 to 3.2% by mass, Mg 1.0 to 2.0% by mass, Ni 0.5 to 2.0% by mass, Fe 0.5 to 2.0% by mass, and at least one selected from the group consisting of Ti 0.01 to 0.35% by mass, Zr 0.01 to 0.30% by mass, Sc 0.01 to 0.8% by mass, and V 0.01 to 0.5% by mass, with the balance being aluminum and inevitable impurities, with the [(Cu content)+0.5×(Mg content)] being 3.8% by mass or less, and with a secondary dendrite arm spacing being 50 μm or less, wherein the cast aluminum alloy is being reinforced by a solution treatment and an aging treatment, and wherein the compressor wheel shows good heat resistant strength, and is for use in a turbocharger.

Other and further features and advantages of the invention will appear more fully from the following description, taken in connection with the accompanying drawings.

DETAILED DESCRIPTION OF THE INVENTION

Figure 1:
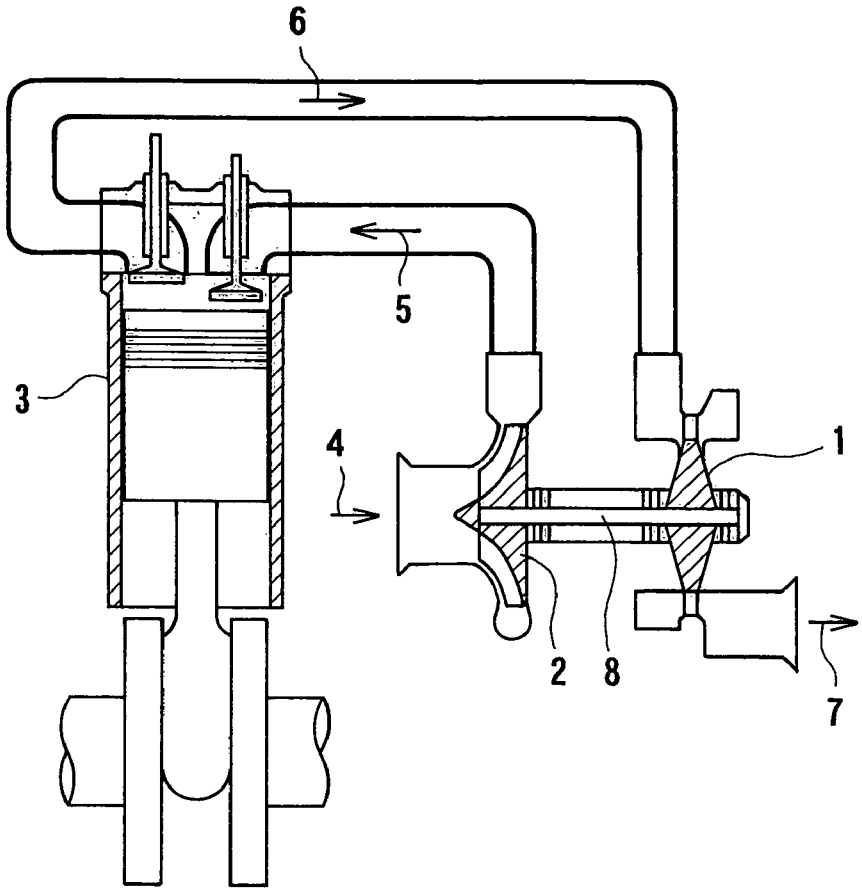
FIG. 1 is an explanatory view for illustrating a turbocharger.
Figure 2:
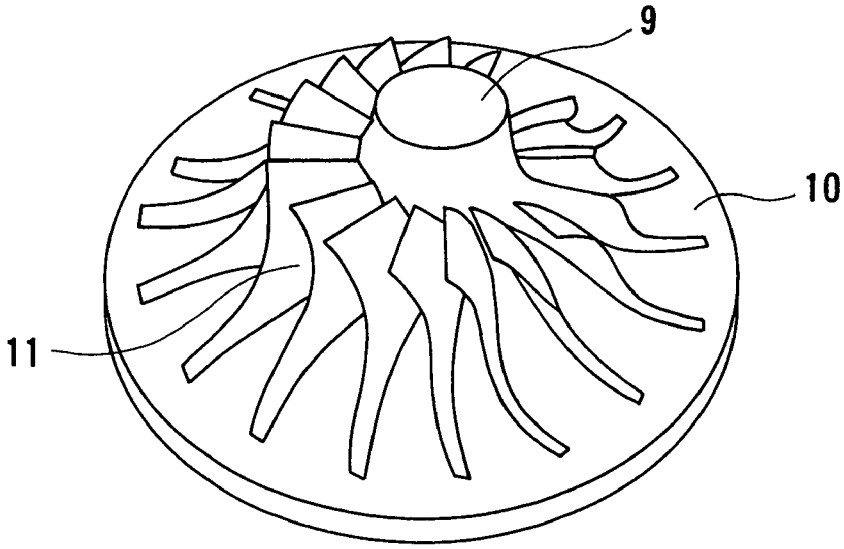
FIG. 2 is a perspective view showing an example of the structure of a compressor wheel.

According to the present invention, there is provided the following means:

(1) A compressor wheel made of a cast aluminum alloy, wherein the cast aluminum alloy comprises Cu 1.4 to 3.2% by mass, Mg 1.0 to 2.0% by mass, Ni 0.5 to 2.0% by mass, Fe 0.5 to 2.0% by mass, and at least one selected from the group consisting of Ti 0.01 to 0.35% by mass, Zr 0.01 to 0.30% by mass, Sc 0.01 to 0.8% by mass, and V 0.01 to 0.5% by mass, with the balance being aluminum and inevitable impurities, with the [(Cu content)+0.5×(Mg content)] being 3.8% by mass or less, and with a secondary dendrite arm spacing being 50 μm or less, wherein the cast aluminum alloy is being reinforced by a solution treatment and an aging treatment, and wherein the compressor wheel shows good heat resistant strength, and is for use in a turbocharger;

(2) The compressor wheel made of a cast aluminum alloy according to item (1), whose proof stress at 180° C. is 250 MPa or more; and (3) The compressor wheel made of a cast aluminum alloy according to item (1) or (2), wherein a temperature of a plaster mold is controlled to 180 to 250° C. in casting by using the plaster mold, and the compressor wheel is produced by providing a metal chill member on an opposite surface of the plaster mold in contact with a disk portion surface of the compressor wheel.

Herein, the phrase "excellent in heat resistant strength" as used herein means that the cast product is not deformed or broken by fatigue even by using it at a temperature of as high as about 180° C.

The present invention will be described in detail below.

The inventors of the present invention have made various experiments and studied for solving the above problems in the conventional technique, and we found that a mechanical strength durable to uses at a temperature of as high as 180° C. can be obtained, while maintaining castability, by selecting specific additive elements and combination thereof in Al—Cu—Mg-based alloys in a specific range, and by specifically controlling the secondary dendrite arm spacing.

The reason why the range of the composition of the aluminum alloy in the present invention is defined will be described below.

Cu and Mg have effects for enhancing mechanical strength through solid-solution strengthening by forming a solid solution in an Al matrix. Further, when Cu and Mg co-exist, they contribute for improving the strength through precipitation hardening by $Al_2Cu$, $Al_2CuMg$, and the like. However, adding excess amounts of these two elements may deteriorate castability, since they act to expand the solidification temperature range. A desired mechanical strength at a high temperature of 180° C. cannot be obtained when the content of Cu is less than 1.4% by mass or the content of Mg is less than 1.0% by mass. On the other hand, when the content of Cu exceeds 3.2% by mass or the content of Mg exceeds 2.0% by mass, or when these are contained in such a manner that [(the content of Cu)+0.5×(the content of Mg)] (hereinafter referred to as "Cu+0.5 Mg") exceeds 3.8% by mass, castability required for the alloy to be cast into the compressor wheel deteriorates, particularly insufficient filling is liable to occur due to miss run of the molten alloy at the tip of the blade. The preferable ranges of addition are Cu 1.7 to 2.8% by mass, Mg 1.3 to 1.8% by mass, and (Cu+0.5 Mg) 2.3 to 3.5% by mass, to surely prevent troubles or failures such as deformation during use and to reduce occurrence of insufficient filling during the casting process to be as small as possible in order to attain an industrially preferable yield.

Ni and Fe have effects for improving the high temperature strength of the alloy by dispersing and forming an intermetallic compound with Al. The required lower limit of the contents of Ni and Fe each are 0.5% by mass or more. However, when the contents of these elements are too large, not only the intermetallic compound is coarsened, but also the mechanical strength is rather decreased by reducing the content of Cu solid-dissolution in the Al matrix as a result of forming $Cu_2FeAl_7$ and $Cu_3NiAl_6$ at a high temperature. Therefore, the upper limits of Ni and Fe each are 2.0% by mass or less. The preferable ranges of addition of these elements are Fe 0.7 to 1.5% by mass and Ni 0.5 to 1.4% by mass. The lower limit(s) of the preferable range(s) is a measure for realizing stable industrial mass production by taking uneven production conditions into consideration, while the upper limit(s) is the addition amount that addition of this element(s) exceeding the amount is not necessary since the effect is saturated.

At least one of Ti, Zr, Sc and V is added, since these elements have effects for improving a supplying property of the molten alloy by fining the solidified texture during the casting process, and for improving run of the molten alloy. The effect above cannot be sufficiently obtained when the amount(s) of addition of these elements are less than 0.01% by mass. However, when the content of Ti exceeds 0.35% by mass, the content of Zr exceeds 0.30% by mass, the content of Sc exceeds 0.8% by mass, or the content of V exceeds 0.5% by mass, coarse intermetallic compounds with a size of several tens to several hundreds micrometers are formed with Al, and these intermetallic compounds serve as starting points of fatigue cracks at the rotation, to thereby reduce reliability of the compressor wheel. A cast crystal grain-fining material that contains Ti, for example a commercially available Al-5% Ti-1% B alloy or Al-5% Ti-0.2% C, may be used instead of pure Ti when Ti is added. The preferable ranges are Ti 0.05 to 0.20% by mass, Zr 0.05 to 0.20% by mass, Sc 0.15 to 0.65% by mass, and V 0.05 to 0.3% by mass. The lower limit(s) of the preferable range(s) is a measure for realizing stable industrial mass production by taking uneven production conditions into consideration, while the upper limit(s) is the addition amount that addition of these elements exceeding this limit is not necessary since the effect is saturated.

The permissible contents of inevitable impurity elements other than the elements described above are Si up to about 0.3% by mass, and Zn, Mn, Cr, or the like up to about 0.2% by mass.

The aluminum alloy according to the present invention in which the components are defined as described above, is cast into the compressor wheel shape, by a low-pressure casting method, a reduced-pressure casting method, or a gravity casting method, generally using a plaster mold, after treatments of the molten alloy (e.g. degassing treatment and inclusion-removing treatment), if necessary, according to conventional methods for producing cast Al—Si-series aluminum alloys. At that time, the solidification conditions should be controlled such that the secondary dendrite arm spacing would be 50 μm or less. This is to prevent fatigue breakage that may be caused by repeated stress generated by acceleration and deceleration of rotation of the compressor wheel. When the secondary dendrite arm spacing exceeds 50 μm, fatigue cracks tend to be occurred and developed along the intermetallic compounds linearly distributed along the boundaries of the coarse dendrite arms. To completely prevent the fatigue cracks from occurring, the secondary dendrite arm spacing is made to be preferably 40 μm or less. The lower limit of the secondary dendrite arm spacing is not particularly limited, and it is sufficient that the secondary dendrite arm can be recognized in the alloy, i.e. the secondary dendrite arm spacing is more than 0 μm. It is effective to increase the cooling speed for reducing the secondary dendrite arm spacing, and the above specific secondary dendrite arm spacing can be attained, for example, by adjusting the size of the plaster mold, by specifically providing a (e.g. metal) chill member to the mold, by controlling the preheat temperature of the plaster mold, and by controlling the casting temperature. These casting conditions are required to be properly determined depending on production facilities and the size of the product.

For effectively utilizing solid-solution hardening by Cu, precipitation hardening by Cu and Mg, and dispersion hardening by forming intermetallic compounds between Al and Fe and between Al and Ni, solution treatment and aging treatment should be applied after casting. It is preferable to reinforce the alloy by applying the solution treatment in a temperature range from below a solidus temperature to a temperature lower by 5 to 25° C. than the solidus temperature, followed by applying the aging treatment at 180 to 230° C. for 3 to 30 hours. The solution treatment is more preferably applied at a temperature range of 510 to 530° C. The aging treatment is more preferably applied in a temperature range of 190 to 210° C. for 5 to 20 hours. Precipitation hardening enough for effectively hardening cannot be attained when the aging treatment temperature is too low or the aging treatment time is too short. On the other hand, when the aging treatment temperature is too high or the aging treatment time is too long, it becomes difficult to attain hardening ability due to coarsening of the precipitation phase formed (i.e. overaging), and solution hardening ability of Cu decreases.

Thus, the cast aluminum alloy compressor wheel for a turbocharger excellent in heat resistance can be obtained by the process as described above.

Further, in the cast aluminum alloy compressor wheel for a turbocharger in the second embodiment of the present invention, the composition is controlled while the solution treatment and aging treatment are applied such that proof stress at 180° C. would be 250 MPa or more, to prevent high-temperature deformation during the use. The preferable lower limit of 250 MPa of the proof stress is a mechanical strength necessary for preventing deformation at high-speed rotation at 180° C. To surely prevent the deformation, the proof stress at 180° C. is more preferably 260 MPa or more. The upper limit of the proof stress at 180° C. is not particularly limited, but it is a value lower than the tensile strength of the alloy.

Further, in the cast aluminum alloy compressor wheel for a turbocharger in the third embodiment of the present invention, when casting by using a plaster mold, the temperature of the plaster mold is adjusted to 180 to 250° C. and a metal chill member is disposed on the backing surface of the chill member in contact with the disk portion of the compressor wheel. When the temperature of the plaster mold is too low, solidification is completed before the molten alloy has arrived at the tip of the thin blade, thereby being apt to cause insufficient filling. The temperature of the plaster mold is preferably in the range of 190 to 240° C., to industrially and stably prevent insufficient filling, and to stably make the secondary dendrite arm spacing fine. The solidification speed becomes slow unless any chill member is provided, and the secondary dendrite arm spacing may not be stably made fine. The material of the chill pate is preferably copper or a copper alloy due to its high heat conductivity, but another material, e.g. iron and stainless steel, may be used. The chill member may be additionally cooled with water or the like, and cooling with water is preferable for temperature control in industrial mass-production.

The cast aluminum alloy compressor wheel of the present invention is excellent in productivity without relying on a measure such as making it complex in structure that results in increase of the production cost, and it shows good heat resistant strength durable to use at a temperature as high as about 180° C. caused by high-speed rotation.

According to the present invention, the aluminum alloy compressor wheel durable to an elevated temperature as a result of increase of the rotation speed, can be supplied with a low production cost. The cast aluminum alloy compressor wheel of the present invention can contribute to enhancement of output of internal combustion engines by increasing the air-feeding ability of the turbocharger utilized for the engines. Accordingly, the present invention is able to exhibit industrially remarkable effects.

The present invention will be explained in more detail with reference to the following examples, but the invention is not intended to be limited thereto.

EXAMPLES

Example 1

After melting and degassing any of aluminum alloys, as shown in Table 1, in a usual manner, it was cast into a structure of a compressor wheel for a truck turbocharger with disk diameter 96 mm, height 70 mm, the number of blades fourteen, and thickness at the tip of the blade 0.4 mm, by a low-pressure casting method using a plaster mold. The plaster mold was pre-heated to 200° C., and a copper chill member was placed on the backing surface of the mold in contact with the bottom face of the disk. Then, the cast compressor wheel was subjected to a solution treatment at 530° C. for 8 hours, followed by an aging treatment at 200° C. for 20 hours. Then, a rod as a test piece in a tension test, was sampled from the center shaft of the compressor wheel, and proof stress of the test piece was measured at room temperature, 150° C., and 180° C. The metal texture at a position apart by 10 mm from the bottom of the disk was observed on the cross-section of the center shaft, under an optical microscope at a magnification of 100 times, to determine a secondary dendrite arm spacing by a tangent method. These measuring methods are described in "Methods for Measuring Dendrite Arm Spacing of Aluminum and Cooling Speed," Report of Investigation Division, the Japan Institute of Light Metals, No. 20 (1988), pages 46 to 52.

Upon the casting, the case where at least one portion was recognized that the molten alloy did not run in the shaft portion and the bottom portion including the blade portions, is designated to "miss run of the molten alloy". The following table shows the Results of casting, by using incidence (%) of the miss run of molten alloy in 100 tests.

The endurance test was carried out as follows. The thus-obtained sample compressor wheel was set to an engine equipped with a turbocharger, and the resultant wheel was tested under the conditions of given values of the rotation number (rpm), period of time (hr), and temperature (° C.) at the outlet side of the wheel, as described in Table 1. Then, the tested wheel was observed with the naked eye.

TABLE 1

| Remarks | No. | Alloy composition (mass %) Cu | Mg | Cu + 0.5 Mg | Ni | Fe | Ti | Zr | Sc | V | Si | Al |
|---|---|---|---|---|---|---|---|---|---|---|---|---|
| Example of this invention | 1 | 1.48 | 1.17 | 2.07 | 0.60 | 0.84 | 0.03 | 0.13 | 0.00 | 0.00 | 0.21 | Balance |
| | 2 | 1.68 | 1.77 | 2.57 | 1.05 | 0.95 | 0.00 | 0.00 | 0.67 | 0.00 | 0.06 | Balance |
| | 3 | 1.90 | 1.35 | 2.58 | 1.34 | 1.55 | 0.00 | 0.26 | 0.24 | 0.00 | 0.18 | Balance |
| | 4 | 2.11 | 1.48 | 2.85 | 0.97 | 1.01 | 0.06 | 0.00 | 0.00 | 0.00 | 0.12 | Balance |
| | 5 | 2.23 | 1.56 | 3.01 | 1.21 | 1.02 | 0.21 | 0.00 | 0.00 | 0.00 | 0.22 | Balance |
| | 6 | 2.30 | 1.62 | 3.11 | 1.77 | 0.59 | 0.00 | 0.17 | 0.19 | 0.19 | 0.28 | Balance |
| | 7 | 2.78 | 1.44 | 3.50 | 0.78 | 1.06 | 0.11 | 0.04 | 0.10 | 0.00 | 0.05 | Balance |
| | 8 | 3.02 | 1.22 | 3.63 | 0.89 | 1.80 | 0.31 | 0.00 | 0.00 | 0.00 | 0.19 | Balance |
| Comparative example | 9 | 1.23 | 0.87 | 1.67 | 0.97 | 1.01 | 0.06 | 0.00 | 0.00 | 0.00 | 0.06 | Balance |
| | 10 | 1.46 | 0.81 | 1.87 | 1.22 | 0.86 | 0.06 | 0.11 | 0.00 | 0.00 | 0.18 | Balance |
| | 11 | 1.18 | 1.34 | 1.85 | 0.91 | 1.34 | 0.11 | 0.00 | 0.00 | 0.00 | 0.12 | Balance |
| | 12 | 3.34 | 1.45 | 4.07 | 0.97 | 1.01 | 0.06 | 0.00 | 0.00 | 0.00 | 0.22 | Balance |
| | 13 | 1.90 | 2.39 | 3.10 | 1.21 | 1.02 | 0.21 | 0.00 | 0.00 | 0.19 | 0.28 | Balance |
| | 14 | 3.16 | 1.55 | 3.94 | 1.77 | 0.59 | 0.02 | 0.17 | 0.19 | 0.00 | 0.18 | Balance |
| | 15 | 2.11 | 1.48 | 2.85 | 0.22 | 0.34 | 0.00 | 0.12 | 0.02 | 0.00 | 0.12 | Balance |
| | 16 | 2.30 | 1.62 | 3.11 | 1.77 | 0.13 | 0.02 | 0.14 | 0.00 | 0.00 | 0.22 | Balance |
| | 17 | 2.78 | 1.44 | 3.50 | 0.23 | 0.67 | 0.11 | 0.04 | 0.10 | 0.00 | 0.25 | Balance |
| | 18 | 2.67 | 1.45 | 3.40 | 1.34 | 1.55 | 0.002 | 0.001 | 0.000 | 0.00 | 0.18 | Balance |
| | 19 | 1.88 | 1.67 | 2.72 | 1.05 | 0.95 | 0.45 | 0.08 | 0.12 | 0.19 | 0.12 | Balance |
| | 20 | 2.06 | 1.89 | 3.01 | 1.05 | 0.95 | 0.05 | 0.34 | 0.12 | 0.56 | 0.22 | Balance |
| | 21 | 1.88 | 1.54 | 2.65 | 1.00 | 1.12 | 0.45 | 0.08 | 1.02 | 0.18 | 0.28 | Balance |
| Conventional example | 22 | 0.03 | 0.38 | 0.22 | 0.00 | 0.11 | 0.11 | 0.00 | 0.00 | 0.00 | 7.20 | Balance |
| | 23 | 1.22 | 0.52 | 1.48 | 0.00 | 0.11 | 0.00 | 0.00 | 0.00 | 0.00 | 5.10 | Balance |
| | 24 | 1.82 | 0.55 | 2.10 | 0.01 | 0.10 | 0.15 | 0.00 | 0.00 | 0.00 | 9.12 | Balance |

| Remarks | No. | Results of casting (incidence of miss run of molten alloy in 100 pieces) (%) | Secondary dendrite arm spacing (μm) | Proof stress Room temp. (MPa) | 150° C. (MPa) | 180° C. (MPa) | Results of endurance test (150,000 rpm × 200 hours, outlet side temperature: 180° C.) |
|---|---|---|---|---|---|---|---|
| Example of this invention | 1 | 0 | 28 | 365 | 300 | 255 | No problem in operation, although the disk was slightly deformed |
| | 2 | 2 | 26 | 374 | 303 | 258 | No problem in operation, although the disk was slightly deformed |
| | 3 | 3 | 30 | 379 | 310 | 263 | No deformation and cracks |
| | 4 | 2 | 29 | 397 | 332 | 269 | No deformation and cracks |
| | 5 | 2 | 28 | 401 | 336 | 287 | No deformation and cracks |
| | 6 | 1 | 31 | 404 | 339 | 290 | No deformation and cracks |
| | 7 | 7 | 25 | 410 | 338 | 293 | No deformation and cracks |
| | 8 | 8 | 24 | 421 | 345 | 298 | No deformation and cracks |
| Comparative example | 9 | 1 | 29 | 311 | 210 | 134 | Large deformation occurred in the disk |
| | 10 | 0 | 31 | 309 | 207 | 129 | Large deformation occurred in the disk |
| | 11 | 1 | 30 | 313 | 209 | 132 | Large deformation occurred in the disk |
| | 12 | 42 | 26 | 432 | 357 | 303 | No deformation and cracks |
| | 13 | 37 | 28 | 399 | 330 | 279 | No deformation and cracks |
| | 14 | 31 | 32 | 418 | 360 | 290 | No deformation and cracks |
| | 15 | 2 | 32 | 324 | 290 | 221 | Large deformation occurred in the disk |
| | 16 | 3 | 28 | 312 | 287 | 211 | Large deformation occurred in the disk |
| | 17 | 4 | 29 | 321 | 298 | 231 | Large deformation occurred in the disk |
| | 18 | 31 | 33 | 412 | 340 | 278 | No deformation and cracks |
| | 19 | 3 | 23 | 383 | 312 | 264 | Large fatigue cracks occurred in the disk |
| | 20 | 2 | 27 | 370 | 314 | 256 | Large fatigue cracks occurred in the disk |
| | 21 | 0 | 23 | 389 | 310 | 256 | Large fatigue cracks occurred in the disk |
| Conventional example | 22 | 3 | 28 | 220 | 186 | 112 | Large deformation occurred in the disk |
| | 23 | 3 | 29 | 296 | 204 | 124 | Large deformation occurred in the disk |
| | 24 | 2 | 30 | 326 | 265 | 141 | Large deformation occurred in the disk |

Note 1:
Conventional Example Nos. 22, 23, and 24 correspond to ASTM-356.0 alloy, ASTM-C355.0 alloy, and ASTM-354.0 alloy, respectively.
Note 2:
The tension tests at 150° C. and 180° C. were carried out at the respective temperature, after heating each test piece to the temperature and maintaining it at the temperature for 1,000 hours.

The samples in Comparative Example Nos. 9 to 11 containing a too small amount of Cu and/or Mg, each were poor in high-temperature proof stress, resulting in deformation of the disk in the endurance test at 180° C. The samples in Comparative Example Nos. 12 to 14, in which the content of Cu and/or Mg was too large, or in which the contents of each of Cu and Mg were below the defined upper limit, but the (Cu+0.5Mg) was too large exceeding 3.8% by mass, each caused conspicuous incidence of miss run of the molten alloy exceeding 30% in the casting process, although proof stress of the alloys were high. Thus, these samples for comparison were not suitable for industrial production, due to their low production yield. The samples in Comparative Example Nos. 15 to 17 containing a too small amount of Ni and/or Fe, each was poor in high-temperature proof stress, resulting in deformation of the disk portion and the like in the endurance test at 180° C. The sample in Comparative Example No. 18 containing too small amounts of Ti, Zr, Sc and V, caused conspicuous occurrence or incidence of miss run of the molten alloy exceeding 30% in the casting process, and the sample was not suitable for industrial production. On the other hand, the samples in Comparative Example Nos. 19 to 21 containing any of Ti, Zr, Sc and V exceeding the defined upper limit, formed coarse intermetallic compounds, and fatigue cracks were occurred in the disk during the endurance test. On the contrary, the samples in Example Nos. 1 to 8 according to the present invention, exhibited good castability, which is comparable to that in the samples in Conventional Example Nos. 22 to 24 (incidence of miss run of the molten alloy of 8% or less), and they had excellent high-temperature proof stress, while no problems of large deformation that may cause trouble in operation or cracks were observed in the endurance test at 180° C. for 200 hours.

and thickness at the tip of the blade 0.3 mm, under any of the various conditions, using a plaster mold, as shown in Table 2. Then, the cast compressor wheels were subjected to the solution treatment and/or the aging treatment, as shown in Table 2, followed by the tests and evaluation in the same manner as in Example 1.

In the casting conditions, a negative value (−) of the applied pressure (kPa) means that the test was carried out, under an atmosphere reduced by the negative value from the atmospheric pressure, as indicated in the table; a positive value (+) of the applied pressure means that the test was carried out, under an atmosphere pressurized by the positive value from the atmospheric pressure, as indicated in the table; and zero (0) as the applied pressure means that the test was carried out under the atmospheric pressure.

TABLE 2

| | | Casting conditions | | | | | Solution treatment and aging conditions | |
|---|---|---|---|---|---|---|---|---|
| | | | | | Pre-heating | | | |
| Remarks | No. | Casting method | Applied pressure (kPa) | Casting temperature (° C.) | temperature of plaster mold (° C.) | Chill member for disk | Soultion treatment (° C. × H) | Aging treatment (° C. × H) |
| Example of this invention | 25 | Reduced-pressure casting | −30 | 740 | 200 | Applied | 530 × 3 | 200 × 12 |
| | 26 | Reduced-pressure casting | −35 | 740 | 190 | Applied | 520 × 12 | 185 × 24 |
| | 27 | Reduced-pressure casting | −25 | 730 | 210 | Applied | 525 × 10 | 200 × 20 |
| | 28 | Low-pressure casting | 100 | 725 | 225 | Applied | 530 × 12 | 205 × 8 |
| | 29 | Low-pressure casting | 90 | 738 | 245 | Applied | 520 × 24 | 200 × 15 |
| | 30 | Gravity casting | 0 | 750 | 200 | Applied | 525 × 6 | 220 × 3 |
| Comparative example | 31 | Reduced-pressure casting | −35 | 750 | 25 | Applied | 525 × 10 | 200 × 20 |
| | 32 | Reduced-pressure casting | −35 | 750 | 160 | Applied | 525 × 10 | 200 × 20 |
| | 33 | Reduced-pressure casting | −35 | 750 | 260 | Applied | 525 × 10 | 200 × 20 |
| | 34 | Reduced-pressure casting | −35 | 740 | 230 | Not applied | 530 × 12 | 205 × 8 |
| | 35 | Low-pressure casting | 100 | 740 | 230 | Not applied | 530 × 12 | 205 × 8 |
| | 36 | Low-pressure casting | 100 | 725 | 200 | Applied | Not applied | 205 × 8 |
| | 37 | Low-pressure casting | 100 | 725 | 200 | Applied | 450 × 2 | 205 × 8 |
| | 38 | Low-pressure casting | 100 | 725 | 200 | Applied | 450 × 2 | Not applied |

| | | Results of casting | Secondary | Proof stress | | | |
|---|---|---|---|---|---|---|---|
| Remarks | No. | (incidence of miss run of molten alloy in 100 pieces) (%) | dendrite arm spacing (μm) | Room temp. (MPa) | 150° C. (MPa) | 180° C. (MPa) | Results of endurance test (180,000 rpm × 200 hours, outlet side temperature: 180° C.) |
| Example of this invention | 25 | 3 | 25 | 370 | 305 | 287 | No deformation and cracks |
| | 26 | 8 | 22 | 374 | 302 | 277 | No deformation and cracks |
| | 27 | 2 | 21 | 372 | 308 | 280 | No deformation and cracks |
| | 28 | 1 | 27 | 365 | 299 | 267 | No deformation and cracks |
| | 29 | 0 | 45 | 379 | 311 | 290 | Occurrence of fine fatigue cracks |
| | 30 | 3 | 20 | 356 | 293 | 273 | No deformation and cracks |
| Comparative example | 31 | 67 | 15 | 373 | 311 | 285 | No deformation and cracks |
| | 32 | 56 | 19 | 370 | 308 | 282 | No deformation and cracks |
| | 33 | 1 | 72 | 370 | 308 | 282 | Large fatigue cracks occurred in the disk |
| | 34 | 0 | 123 | 368 | 302 | 265 | Large fatigue cracks occurred in the disk |
| | 35 | 1 | 95 | 368 | 300 | 265 | Large fatigue cracks occurred in the disk |
| | 36 | 1 | 24 | 170 | 145 | 123 | Large deformation occurred in the disk |
| | 37 | 1 | 24 | 281 | 234 | 218 | Large deformation occurred in the disk |
| | 38 | 2 | 32 | 190 | 167 | 148 | Large deformation occurred in the disk |

Note 1:
The tension tests at 150° C. and 180° C. were carried out at the respective temperature, after heating each test piece to the temperature and maintaining it at the temperature for 1,000 hours.

Example 2

After melting and degassing the No. 4 alloy in Table 1, in a usual manner, the resultant alloy was cast into a structure of a compressor wheel for a passenger car turbocharger with disk diameter 50 mm, height 40 mm, the number of blades twelve, Conspicuous incidence of miss run of the molten alloy occurred in the samples in Nos. 31 and 32 produced at a low temperature of the plaster mold. In the sample in No. 33 produced at a high temperature in the pre-heating of the plaster mold and in the samples in Nos. 34 and 35 using no chill member, since the samples each were cooled with a very slow cooling speed upon solidification, the resultant secondary dendrites were coarsened with a too large secondary dendrite arm spacing of exceeding 50 μm. As a result, fatigue cracks were observed in the endurance test of each of these samples in Nos. 33, 34 and 35. Further, the samples in Nos. 36 to 38, in which the solution treatment and/or the aging treatment was omitted or the treatment(s) was insufficient, each were poor in the proof stress at 180° C. of less than 250 MPa, resulting in occurrence of deformation in the endurance test. On the contrary, the cast aluminum alloy compressor wheels in the Example Nos. 25 to 30 according to the present invention, each had the secondary dendrite arm spacing of as fine as 50 μm or less, and they were quite high in the high-temperature proof stress, and they involved no problems in the endurance test. While quite fine fatigue cracks were observed in the endurance test in the sample in No. 29, these cracks were within the permissible range.

Having described our invention as related to the present embodiments, it is our intention that the invention not be limited by any of the details of the description, unless otherwise specified, but rather be construed broadly within its spirit and scope as set out in the accompanying claims.

What is claimed is:

1. A compressor wheel made of a cast aluminum alloy, wherein the cast aluminum alloy consisting essentially of Cu 1.4 to 3.20% by mass, Mg 1.0 to 2.0% by mass, Ni 0.5 to 2.0% by mass, Fe 0.5 to 2.0% by mass, and at least one selected from the group consisting of Ti 0.01 to 0.35% by mass, Zr 0.01 to 0.30% by mass, Sc 0.01 to 0.8% by mass, and V 0.01 to 0.5% by mass, with the balance being aluminum and inevitable impurities, the inevitable impurities comprising Si up to about 0.3% by mass, and Zn, Mn and Cr up to about 0.2% by mass, with the [(Cu content)+0.5×(Mg content)] being 3.8% by mass or less, and with a secondary dendrite arm spacing being 50 μm or less, wherein the cast aluminum alloy is being reinforced by a solution treatment and an aging treatment, and wherein the compressor wheel shows good heat resistant strength, and is for use in a turbocharger.

2. The compressor wheel according to claim 1, wherein a temperature of a plaster mold is controlled to 180 to 250° C. in casting by using said plaster mold, and the compressor wheel is produced by providing a metal chill member on an opposite surface of the plaster mold in contact with a disk portion surface of said compressor wheel.

3. The compressor wheel according to claim 1, whose proof stress at 180° C. is 250 MPa or more.

4. The compressor wheel according to claim 3, wherein a temperature of a plaster mold is controlled to 180 to 250° C. in casting by using said plaster mold, and the compressor wheel is produced by providing a metal chill member on an opposite surface of the plaster mold in contact with a disk portion surface of said compressor wheel.

5. A cast aluminum alloy consisting essentially of Cu 1.4 to 3.2% by mass, Mg 1.0 to 2.0% by mass, Ni 0.5 to 2.0% by mass, Fe 0.5 to 2.0% by mass, and at least one selected from the group consisting of Ti 0.01 to 0.35% by mass, Zr 0.01 to 0.30% by mass, Sc 0.01 to 0.8% by mass, and V 0.01 to 0.5% by mass, with the balance being aluminum and inevitable impurities, the inevitable impurities comprising Si up to about 0.3% by mass, and Zn, Mn and Cr up to about 0.2% by mass, with the [(Cu content)+0.5×(Mg content)] being 3.8% by mass or less, and with a secondary dendrite arm spacing being 50 μm or less.

6. A cast aluminum alloy consisting essentially of Cu 1.4 to 3.2% by mass, Mg 1.0 to 2.0% by mass, Ni 0.5 to 2.0% by mass, Fe 0.5 to 2.0% by mass, and at least one selected from the group consisting of Ti 0.01 to 0.35% by mass, Zr 0.01 to 0.30% by mass, Sc 0.01 to 0.8% by mass, and V 0.01 to 0.5% by mass, with the balance being aluminum and inevitable impurities, the inevitable impurities comprising Si up to about 0.3% by mass, and Zn, Mn and Cr up to about 0.2% by mass, with the [(Cu content)+0.5×(Mg content)] being 3.8% by mass or less.

7. A cast aluminum alloy according to claim 6, wherein the cast aluminum alloy has a proof stress of 250 MPa or more at 180° C.

8. A cast aluminum alloy according to claim 6, wherein the cast aluminum alloy has a secondary dendrite arm spacing of 50 μm or less, and wherein the cast aluminum alloy is capable of using a compressor wheel.

9. A cast aluminum alloy according to claim 6, wherein the cast aluminum alloy is capable of using a compressor wheel.

* * * * *